US009014413B2

(12) United States Patent
Cheung

(10) Patent No.: US 9,014,413 B2
(45) Date of Patent: Apr. 21, 2015

(54) DUAL COIL LOUDSPEAKER SYSTEM

(71) Applicant: The Boeing Company, Chicago, IL (US)

(72) Inventor: Kwun-Wing W. Cheung, Shoreline, WA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 13/972,500

(22) Filed: Aug. 21, 2013

(65) Prior Publication Data

US 2015/0055819 A1 Feb. 26, 2015

(51) Int. Cl.
*H04R 25/00* (2006.01)
*H04R 1/00* (2006.01)

(52) U.S. Cl.
CPC ..... *H04R 1/00* (2013.01)

(58) Field of Classification Search
USPC ..... 381/400–402, 404, 406–410
See application file for complete search history.

(56) References Cited

U.S. PATENT DOCUMENTS

| | | | | |
|---|---|---|---|---|
| 4,322,583 | A | 3/1982 | Maeda | |
| 4,514,599 | A | 4/1985 | Yanagishima et al. | |
| 4,551,849 | A | 11/1985 | Kasai et al. | |
| 4,566,120 | A * | 1/1986 | Nieuwendijk et al. | 381/401 |
| 4,586,192 | A * | 4/1986 | Arntson | 381/402 |
| 4,897,877 | A | 1/1990 | Tetzlaff | |
| 5,212,732 | A * | 5/1993 | Hipps et al. | 381/401 |
| 5,699,438 | A | 12/1997 | Smith et al. | |
| 5,708,719 | A | 1/1998 | Greenberger et al. | |
| 6,031,926 | A | 2/2000 | Azima et al. | |
| 6,058,196 | A | 5/2000 | Heron | |
| 6,144,746 | A | 11/2000 | Azima et al. | |
| 6,188,775 | B1 | 2/2001 | Azima et al. | |
| 6,198,831 | B1 | 3/2001 | Azima et al. | |
| 6,215,882 | B1 | 4/2001 | Heron | |
| 6,237,715 | B1 | 5/2001 | Tracy | |
| 6,247,551 | B1 | 6/2001 | Heron | |
| 6,304,661 | B1 | 10/2001 | Azima et al. | |
| 6,320,967 | B1 | 11/2001 | Azima et al. | |
| 6,327,369 | B1 | 12/2001 | Azima et al. | |
| 6,332,029 | B1 | 12/2001 | Azima et al. | |
| 6,377,695 | B1 | 4/2002 | Azima et al. | |
| 6,442,282 | B2 | 8/2002 | Azima et al. | |

(Continued)

FOREIGN PATENT DOCUMENTS

| | | |
|---|---|---|
| WO | 92/03024 | 2/1992 |
| WO | 97/09858 | 3/1997 |
| WO | 98/26630 | 6/1998 |

OTHER PUBLICATIONS

"JBL's Differential Drive® Transducers," JBL Professional, Technical Note vol. 1, No. 33, 8 pages.

(Continued)

*Primary Examiner* — Suhan Ni
(74) *Attorney, Agent, or Firm* — Thompson Hine LLP

(57) ABSTRACT

A dual coil loudspeaker system having a voice coil having a first coil configured to receive a first electrical signal from a first source, and a second coil configured to receive a second electrical signal from a second source different from the first source; a field magnet configured to generate a magnetic field that interacts with magnetic fields created by the first coil and the second coil; and a diaphragm connected to the voice coil such that the diaphragm is displaced in response to energization of at least one of the first coil and the second coil.

24 Claims, 3 Drawing Sheets

(56) References Cited

U.S. PATENT DOCUMENTS

| | | | | |
|---|---|---|---|---|
| 6,478,109 | B1 | 11/2002 | Kam | |
| 6,494,289 | B1 | 12/2002 | Bachmann et al. | |
| 6,519,347 | B1 | 2/2003 | Morecroft et al. | |
| 6,519,349 | B1 | 2/2003 | Azima et al. | |
| 6,681,026 | B2 | 1/2004 | Kam | |
| 6,782,111 | B1 * | 8/2004 | Wagner, II et al. | 381/401 |
| 6,826,285 | B2 | 11/2004 | Azima | |
| 7,088,836 | B1 | 8/2006 | Bachmann et al. | |
| 7,194,098 | B2 | 3/2007 | Azima et al. | |
| 7,283,637 | B2 | 10/2007 | Suzuki et al. | |
| 7,447,322 | B2 | 11/2008 | Harris, Jr. et al. | |
| 7,817,810 | B2 | 10/2010 | Cheung | |
| 8,139,795 | B2 | 3/2012 | Scheel et al. | |
| 8,165,336 | B2 | 4/2012 | Iino et al. | |
| 8,180,065 | B2 | 5/2012 | Snider | |
| 8,247,930 | B2 | 8/2012 | Yamagishi | |
| 2002/0018575 | A1 | 2/2002 | Bream | |
| 2002/0141607 | A1 | 10/2002 | Azima et al. | |
| 2004/0129492 | A1 | 7/2004 | Bertagni et al. | |
| 2006/0110001 | A1 | 5/2006 | Saint Vincent et al. | |
| 2011/0135141 | A1 | 6/2011 | Tanabe | |

OTHER PUBLICATIONS

U.S. Appl. No. 13/929,073, filed Jun. 2013, Cheung.

"JBL's Differential Drive®Transducers," JBL Professional, Technical Note, vol. 1, No. 33, 8 pages (Jun. 2005).

EP, European Search Report and Opinion, European Application No. 14172691.9 (Jan. 20, 2015).

* cited by examiner

DUAL COIL LOUDSPEAKER SYSTEM

FIELD

The disclosure relates to loudspeaker systems, and more particularly, to loudspeaker systems driven by amplifiers.

BACKGROUND

Speaker systems, such as the speaker systems mounted on aircraft and other vehicles, include one or more cone speakers powered by one or more amplifiers. Recent developments in the design of loudspeaker systems incorporate flat panel speakers as part of a vehicle loudspeaker system. An example of such a flat panel speaker system is described in U.S. application Ser. No. 13/929,073 filed Jun. 27, 2013, the contents of which are incorporated herein by reference. With such flat panel speakers, a portion of the panel defining a passenger cabin or other enclosure on a vehicle may be used as the diaphragm of a driver of the loudspeaker system. Because the mass of such flat panel speakers is many times greater than the mass of a conventional cone diaphragm that may be made of paper, plastic, lightweight composites or metal foil, a driver incorporating such a flat panel diaphragm may require an audio signal from an amplifier that is significantly more powerful than the audio signal required to drive a traditional cone speaker.

While employing larger and more powerful amplifiers may provide sufficiently powerful audio signals to such flat panel speakers, such larger and heavier amplifiers add weight to the vehicle, require more onboard electric power, and require extensive testing and certification. Accordingly, there is a need for a loudspeaker (driver or exciter) system that is sufficiently powerful to drive flat panel speakers, but does not require more power from relatively heavy amplifiers that also draw more power from the onboard power supply system.

SUMMARY

In an embodiment, a dual coil loud speaker system may include a voice coil having a first coil configured to receive a first electrical signal from a first source, and a second coil configured to receive a second electrical signal from a second source different from the first source, a field magnet configured to generate a magnetic field that interacts with magnetic fields created by the first coil and the second coil, and a diaphragm connected to the voice coil such that the diaphragm may be displaced in response to energization of at least one of the first coil and the second coil.

In another embodiment of the disclosed dual coil loud speaker system, the system may include an audio signal source including a first amplifier and a second amplifier; a voice coil having a first coil connected to receive a first audio signal from the first amplifier and a second coil connected to receive a second electrical signal from the second amplifier, the first coil electrically isolated from the second coil; a field magnet configured to generate a magnetic field that interacts with magnetic fields created by the first coil and the second coil in response to the first audio signal and the second audio signal, respectively; a diaphragm connected to the voice coil such that the diaphragm may be displaced in response to energization of at least one of the first coil and the second coil in response to the first audio signal and the second audio signal, respectively; and the voice coil including a tube connected to the diaphragm; and wherein the first coil and the second coil may be mounted concentrically on the tube.

In yet another embodiment, a method of generating acoustic vibrations with a dual coil loudspeaker system may include transmitting a first acoustic signal from a first source to a first coil of a voice coil; simultaneously transmitting a second acoustic signal from a second source, different from the first source, to a second coil of the voice coil, the second acoustic signal identical to the first acoustic signal; moving the voice coil by generating varying magnetic fields from the first coil and the second coil in response to the first acoustic signal and the second acoustic signal that interact with a field magnet; and vibrating a diaphragm connected to the voice coil in response to moving the voice coil to generate acoustic vibrations.

Other objects and advantages of the disclosed dual coil loudspeaker system will be apparent from the following description, the accompanying drawings, and the appended claims.

DETAILED DESCRIPTION

Figure 1:
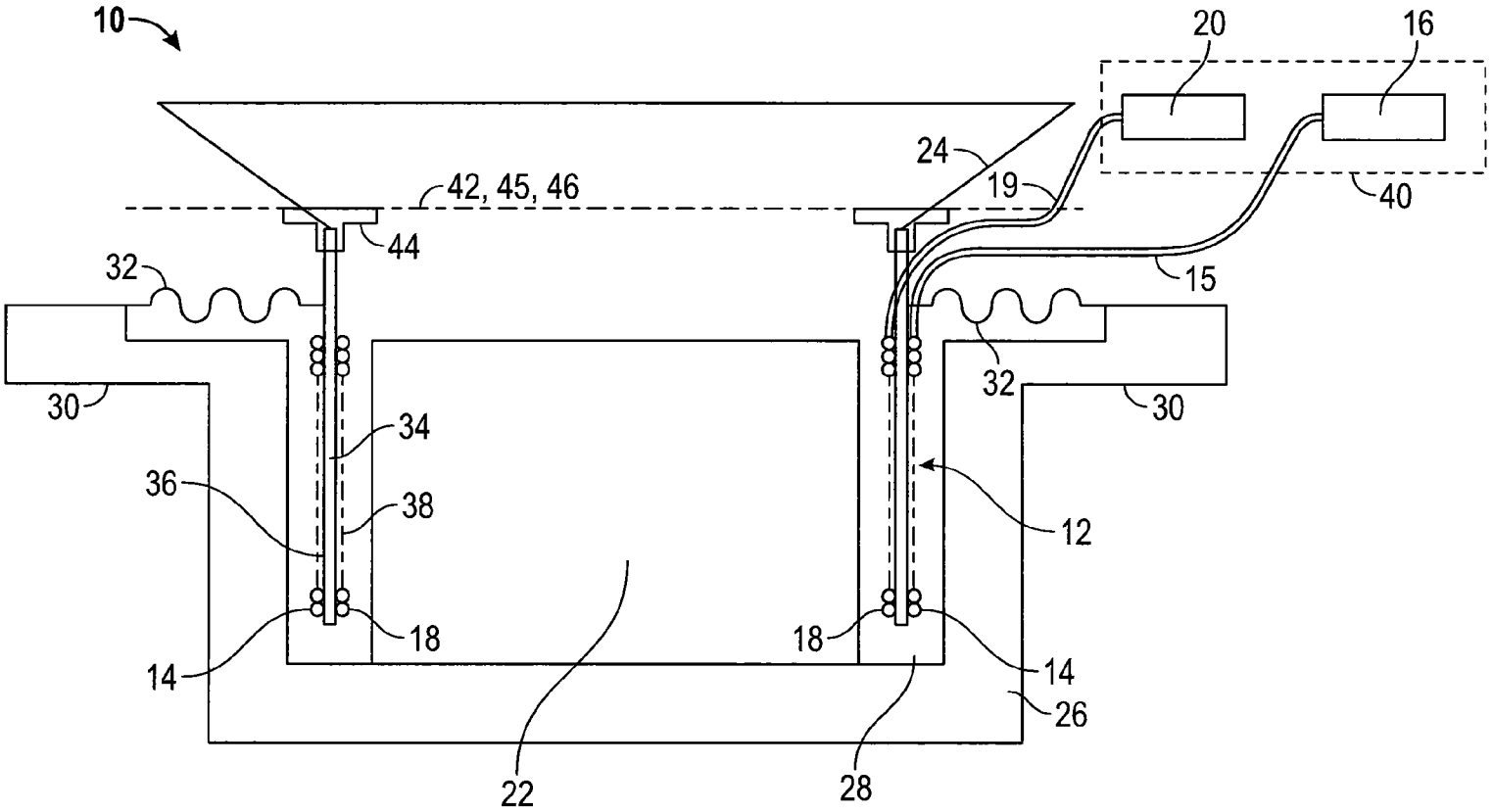
FIG. 1 is a schematic, elevational view in section of an embodiment of the disclosed dual coil loudspeaker system.

As shown in FIG. 1, a dual coil loudspeaker system, generally designated 10, may include a voice coil, generally designated 12, having a first coil 14 configured to receive a first electrical signal over wires 15 from a first source 16, and a second coil 18 configured to receive a second electrical signal over wires 19 from a second source 20, different from the first source. The loudspeaker system 10 may include a field magnet 22 configured to generate a magnetic field that interacts with magnetic fields created by the first coil 14 and second coil 18, and a diaphragm 24 connected to the voice coil 12 such that the diaphragm is displaced in response to energization of at least one of the first coil 14 and second coil 18 by the first source 16 and second source 20, respectively.

The system 10 also may include a housing 26 that may support the field magnet 22 and form a magnetic gap 28 with the voice coil 12. In an embodiment, the housing 26 may be made of steel, or other magnetic material that may conduct or generate a magnetic field. The housing 26 may include an annular flange 30 that may support a spider or suspension 32 that may support and center the voice coil 12 with respect to the housing 26 and field magnet 22.

In an embodiment, the voice coil 12 may include a coil former in the form of a cylindrical tube 34. The tube 34 may be made of a non-conductive material, such as paper or plastic, and may be connected to the diaphragm 24. The first coil 14 and second coil 18 may be mounted on the tube 12. In this configuration, the first coil 14 and the second coil 18 may be concentric with respect to the field magnet 22, which in the embodiment may act as an inner pole piece. In an embodiment, the first coil 14 may be mounted on an outer surface 36 of the tube 34, and the second coil 18 may be mounted on an inner surface 38 of the tube. In the embodiment shown, the first coil 14 and the second coil 18 may be electrically isolated from each other. In an embodiment, the second coil 18 may be adjacent the first coil 14 in a radial dimension of the tube 34. In other embodiments, the first coil 14 may be mounted on the inner surface 38 and the second coil may be mounted on the outer surface 36 of the tube 34. In still other embodiments, the first coil 14 and second coil 18 both may be on the inner surface 38 or outer surface 36, and may be wound to overlap each other.

In an embodiment, the first source 16 may be in the form of a first amplifier connected to transmit the first electrical signal to the first coil 14, and the second source 20 may be in the form of a second amplifier, different from the first amplifier, connected to transmit the second electrical signal to the second coil 18, such that the first coil and the second coil may be energized in unison to excite the diaphragm 24 to make the same sound vibration in phase. In another embodiment, the first source 16 may take the form of a first channel from an amplifier 40 connected to transmit the first electrical signal to the first coil 14, and the second source 20 may take the form of a second channel from the amplifier, different from the first channel, connected to transmit the second electrical signal to the second coil 18 such that the first coil and the second coil are energized in unison to excite the diaphragm 24 to make the same sound vibration in phase. In yet another embodiment, the first source 16 and second source 20 may be two channels of a stereo audio signal.

With either embodiment, in an application, the first electrical signal and the second electrical signal from the first source 16 and the second source 20, respectively, may be substantially identical and in phase. In an embodiment, the first source 16 and second source 20 may be configured to transmit an audio signal to the first coil 14 and second coil 18 over wires 15, 19, respectively.

In an embodiment, the diaphragm 24 may be made of a material selected from paper, plastic, composite, metal, and thin fiberglass sheet. In another embodiment, the diaphragm 24 may be replaced by a panel, generally designated 42, and wherein the tube 34 may include an annular drive pad 44 for attaching the voice coil 12 to the panel 42. As will be discussed in greater detail, the panel 42 may comprise a portion of the cabin wall 45 of a vehicle 46. The vehicle 46 may be selected from an aircraft, a spacecraft, a land vehicle, and a marine vehicle.

Figure 2:
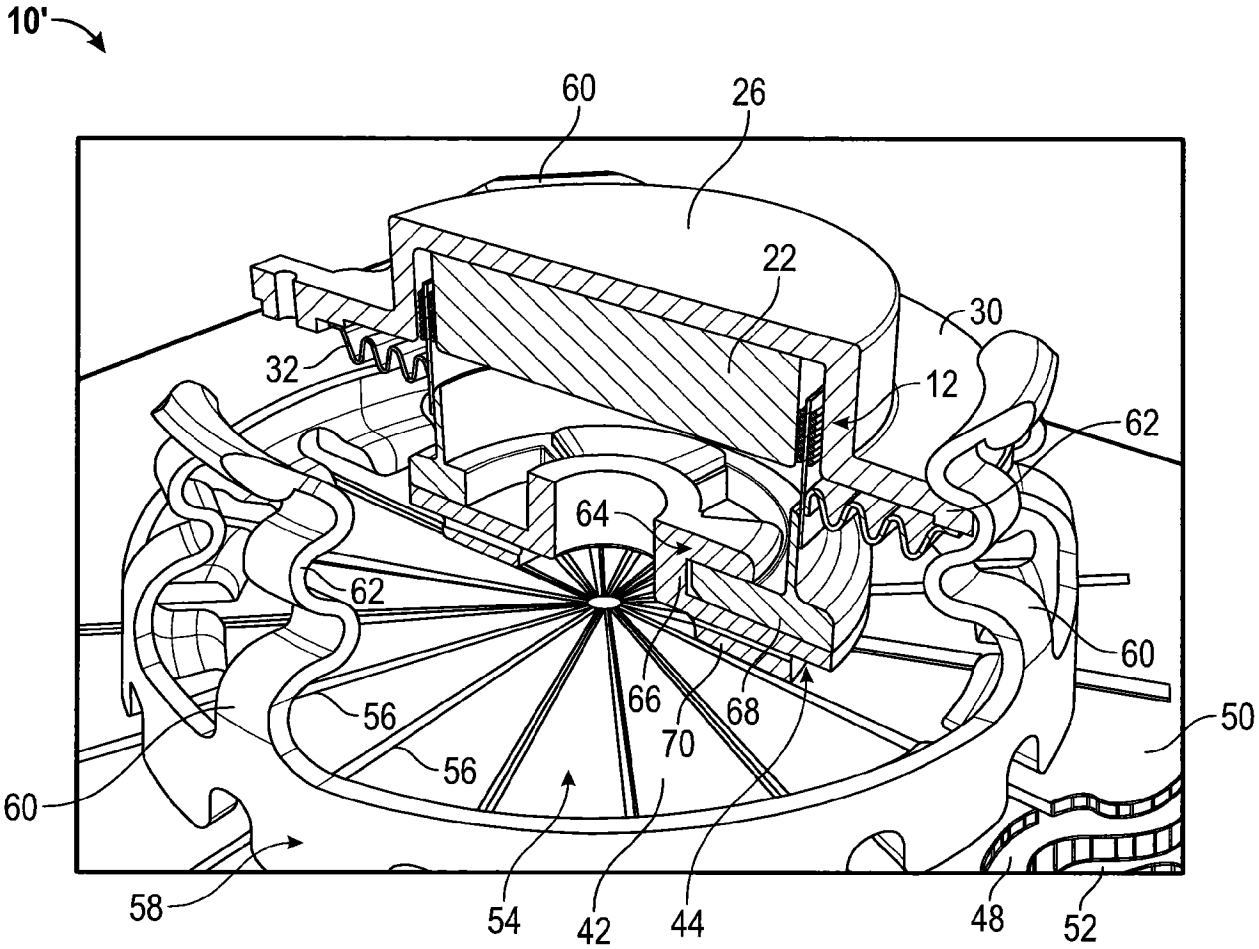
FIG. 2 is a perspective view, partially in section, of another embodiment of the disclosed dual coil loudspeaker system.

As shown in FIG. 2, in an embodiment generally designated 10', the diaphragm may comprise a flat panel 42 of a type having a core 48 and inner sheet 50 coupled to an inner surface of the core and an outer sheet 52 coupled to an outer surface of the core. The panel 42 may include a weakened area, generally designated 54, defined by at least one, and in an embodiment a plurality, of slots 56 formed through the inner sheet 50. The weakened area 54 may be configured to vibrate in response to electrical signals to the voice coil 12 to generate sound vibrations.

The system 10' may include a frame 58, which may contact the diaphragm in the form of the panel 42. In an embodiment, the frame 58 may be attached to the panel 42 by an adhesive. The frame 58 may support the magnet 22. In an embodiment, the frame 58 may include a plurality of upwardly extending fingers 60, each having a circumferentially extending groove 62 shaped to receive the outer periphery of the flange 30 of the housing 26. The suspension 32 may extend from the tube 34 and be anchored to an underside of the flange 30. In an embodiment, the fingers 60 may be sufficiently flexible to allow upward and downward activities of the housing 26. In an embodiment, the housing 26 and voice coil 12 may be releasably held by the frame 58.

In the embodiment 10' illustrated in FIG. 2, the voice coil 12 may include a drive pad 44 that may include a releasable connection 64. The releasable connection 64 may be configured to releasably connect the tube 34 of the voice coil 12 to the panel 42. In an embodiment, the releasable connection 64 may include a lock base 66 that may be attached to the panel 42, such as by an adhesive, and a lock pad 68 that may be attached to the tube 12 and configured to be releasably attached to the lock base.

In an embodiment, the lock base 66 may include a dynamic buffer coupling pad 70 configured to connect the lock base to the diaphragm 42. In an embodiment, the dynamic buffer coupling pad 70 may include at least one layer of double sided tape. Without being limited to any particular theory, the dynamic buffer coupling pad 70 may introduce an elastic material with certain damping properties. Unlike the diaphragm 24 (FIG. 1), which may comprise a very light material, such as thin paper, the mass of a panel 42 may be several thousand times heavier. When a strong audio impulse is transmitted by the amplifiers 16, 20 to the voice coil 12, the voice coil may send a shock wave to the panel 42 that starts from the center of the weakened area 54 to the edges, and bouncing back to the center again. Thus, the mass of the acting panel 42 may be in motion, unable to stop flexing for a short period of time, on the order of a fraction of a second.

In instances where the audio signal creates a deflection of the panel 42 of a relatively large amplitude, when the amplitude bounces back toward the center of the weakened area 54, the delayed mechanical energy may collide with the next firing of a large amplitude signal by the voice coil 12, causing an audio breakup, which may appear as a very noticeable audio distortion. This phenomenon may worsen with panels 54 that are relatively stiff. In such cases, even lesser amplitude audio signals may cause distortion, making the resultant loudspeaker system 10, 10' unable to transmit relatively loud sound vibrations without distortion.

By adding a dynamic buffer coupling pad 70 in between the attachment of the voice coil 12 and diaphragm 42, such a sonic confrontation may be reduced. The degree of softness of the pad 70 may be selected on a case-by-case basis, taking into consideration the power rating of the voice coil 12, the size of the panel 42, the stiffness of the panel and the weight of the panel. The pad 70 may provide a combination of damping and spring function. The pad 70 may be intended to temporarily store the feedback energy of the panel 42. In one embodiment, such a pad 70 may be made from very high bonding ("VHB") double sided tape manufactured by 3M Company of Saint Paul, Minn. The pad 70 may, in embodiments, have a single layer, or up to two or three layers or more to achieve the desired spring property. In an embodiment, the dynamic buffer coupling pad 70 may be made of an elastic damping material of a selected thickness, or semi-flexible epoxy.

Figure 3A:
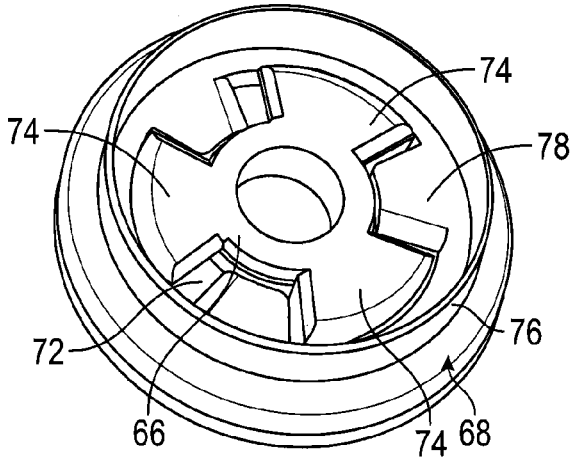
FIGS. 3A, 3B, and 3C are detail views in perspective of the releasable connection of the embodiment of FIG. 2.
Figure 3B:
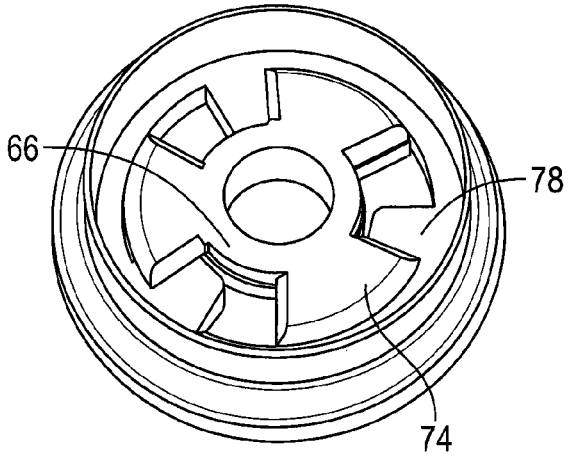
Figure 3C:
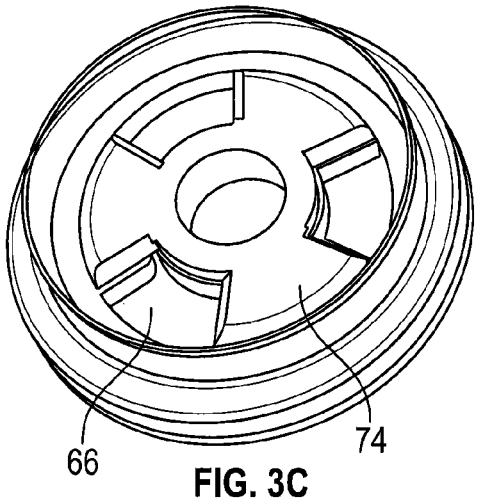

As shown in FIGS. 3A, 3B, and 3C, the lock base 66 may include a flange 72 that may be mounted on the diaphragm, which in the embodiment of FIG. 2 may take the form of a panel 42. The lock base 66 may include three radially projecting tabs 74 that may be spaced from the flange 72. The lock pad 68 may include an upwardly extending annular rib 76 that may be shaped to engage and be attached to the tube 34 of the voice coil 12 (see FIG. 2). The lock pad 68 also may include three regularly inwardly extending fingers 78 that may be shaped to engage the tabs 74 of the lock base 68 in a friction fit.

Accordingly, the voice coil 12 and lock pad 68 may be releasably attached to the lock base 66 by centering and aligning the lock pad relative to the lock base, sliding the lock pad downwardly against the lock base, and rotating the lock pad in a clockwise direction, as shown in FIG. 3B. This may cause the fingers 78 to slide beneath and press against the tabs 74 until, as shown in FIG. 3C, the fingers 78 may be entirely underneath the tabs 74. In an embodiment, the tabs 74 may form a blind slot with the flange 72 that prevents further clockwise rotation of the lock pad 68 relative to the lock base 66. In an embodiment, the spacing between the flange 72 and the tab 74 may provide a frictional engagement with the fingers 78 so that the voice coil 12 may be firmly attached to the diaphragm, which in the embodiment of FIGS. 2 and 3A-C may be in the form of a panel 42.

In operation, the first and second sources 16, 20, which in embodiments may be separate amplifiers, and in other embodiments may be discreet channels of a common amplifier 40, generate electrical signals, which in embodiments are audio signals, which are transmitted over wires 15, 19 to the first and second coils 14, 18, respectively, of the voice coil 12. The varying magnetic fields created by these audio signals may interact with the magnetic field of the field magnet 22 and cause the voice coil 12 to move back and forth in the direction of the magnetic gap 28 (FIG. 1) relative to the field magnet 22. This may cause the diaphragm 24, which may be in the form of panel 42, to vibrate, thereby generating sound energy, which may be in the form of acoustic vibrations.

By utilizing a dual coil loudspeaker system 10, 10', preexisting amplifiers that may not be particularly powerful may be employed, and their audio signals may be combined to power a single voice coil 12. This system 10, 10' may eliminate the need to employ and certify more powerful amplifiers to drive less efficient speakers, such as speakers that utilize a relatively heavy flat panel 42.

While the forms of apparatus and methods described herein constitute preferred embodiments of the dual coiled loudspeaker system, it is to be understood that modifications may be made therein without departing from the scope of the invention.

What is claimed is:

1. A dual coil loudspeaker system comprising:

a voice coil having a first coil configured to receive a first electrical signal from a first source, and a second coil configured to receive a second electrical signal from a second source different from the first source;

a field magnet configured to generate a magnetic field that interacts with magnetic fields created by the first coil and the second coil;

a diaphragm connected to the voice coil such that the diaphragm is displaced in response to energization of at least one of the first coil and the second coil; and the voice coil including a tube connected to the diaphragm, and wherein the first coil and the second coil are mounted on the tube such that the second coil is adjacent the first coil in a radial dimension of the tube.

2. The dual coil loudspeaker system of claim 1, further comprising a frame connected to the diaphragm and supporting the magnet; and a spider connected to suspend the voice coil relative to the frame and center the voice coil relative to the magnet.

3. The dual coil loudspeaker system of claim 2, wherein the field magnet includes an inner pole piece.

4. The dual coil loudspeaker system of claim 1, wherein the first coil and the second coil are electrically isolated from each other.

5. The dual coil loudspeaker system of claim 4, wherein the first coil and the second coil are concentric with respect to the inner pole piece.

6. The dual coil loudspeaker system of claim 1, wherein the first coil is mounted on one of an outer surface of the tube and an inner surface of the tube; and the second coil is mounted on one of the outer surface of the tube and the inner surface of the tube.

7. The dual coil loudspeaker system of claim 6, wherein the first coil is mounted on one of an outer surface of the tube and an inner surface of the tube; and the second coil is mounted on the other one of the outer surface of the tube and the inner surface of the tube.

8. The dual coil loudspeaker system of claim 6, wherein the first coil and second coil both may be on the inner surface or outer surface of the tube.

9. The dual coil loudspeaker system of claim 1, wherein the voice coil includes a releasable connection that releasably connects the tube to the diaphragm.

10. The dual coil loudspeaker system of claim 9, wherein the releasable connection includes a lock base attached to the diaphragm; and a lock pad attached to the tube and releasably attached to the lock base.

11. The dual coil loudspeaker system of claim 10, further comprising a dynamic buffer coupling pad configured to connect the lock base to the diaphragm.

12. The dual coil loudspeaker system of claim 11, wherein the dynamic buffer coupling pad is selected from at least one layer of double-sided tape, and a layer of semi-flexible epoxy.

13. The dual coil loudspeaker system of claim 1, further comprising the first source including a first amplifier connected to transmit the first electrical signal to the first coil; and the second source including a second amplifier, different from the first amplifier, connected to transmit the second electrical signal to the second coil, such that the first coil and the second coil are energized in unison to excite the diaphragm to make the same sound vibration.

14. The dual coil loudspeaker system of claim 1, further comprising the first source including a first channel from an amplifier connected to transmit the first electrical signal to the first coil; and the second source including a second channel from the amplifier, different from the first channel, connected to transmit the second electrical signal to the second coil, such that the first coil and the second coil are energized in unison to excite the diaphragm to make the same sound vibration in phase.

15. The dual coil loudspeaker system of claim 1, wherein the first electrical signal and the second electrical signal are substantially identical.

16. The dual coil loudspeaker system of claim 1, wherein the diaphragm is made of a material selected from paper, plastic, metal, thin fiberglass sheet, and a panel having a core, an inner sheet coupled to an inner surface of the core and an outer sheet coupled to an outer surface of the core, the panel having a weakened area defined by at least one open slot formed through the outer sheet.

17. A dual coil loudspeaker system comprising:

an audio signal source including a first amplifier and a second amplifier;

a voice coil having a first coil connected to receive a first audio signal from the first amplifier, and a second coil connected to receive a second electrical signal from the second amplifier, the first coil electrically isolated from the second coil;

a field magnet configured to generate a magnetic field that interacts with magnetic fields created by the first coil and the second coil in response to the first audio signal and second audio signal, respectively;

a diaphragm connected to the voice coil such that the diaphragm is displaced in response to energization of at least one of the first coil and the second coil in response to the first audio signal and the second audio signal, respectively; and the voice coil including a tube connected to the diaphragm, and wherein the first coil and the second coil are mounted concentrically on the tube such that the second coil is adjacent the first coil in a radial dimension of the tube.

18. The dual coil loudspeaker system of claim 17, further comprising a vehicle, and wherein the diaphragm comprises a portion of a cabin wall of the vehicle.

19. The dual coil loudspeaker system of claim 18, wherein the diaphragm includes a panel having a core, an inner sheet coupled to an inner surface of the core and an outer sheet coupled to an outer surface of the core, the panel having a weakened area defined by at least one open slot formed through the outer sheet, and wherein the tube is centered on the weakened area, the panel being integral with the cabin wall.

20. A method of generating acoustic vibrations with a dual coil loudspeaker system, the method comprising:

transmitting a first acoustic signal from a first source to a first coil of a voice coil;

simultaneously transmitting a second acoustic signal from a second source, different from the first source, to a second coil of the voice coil, the second acoustic signal identical to the first acoustic signal;

mounting the first coil and the second coil on a common tube of the voice coil, and positioning the first voice coil relative to the second voice coil such that the second coil is adjacent the first coil in a radial dimension of the tube;

connecting the tube to a diaphragm;

moving the voice coil by generating varying magnetic fields from the first coil and the second coil in response to the first acoustic signal and the second acoustic signal that interact with a field magnet; and vibrating the diaphragm in response to moving the voice coil to generate acoustic vibrations.

21. The method of claim 20, wherein vibrating the diaphragm includes vibrating a diaphragm that comprises a portion of a cabin wall of a vehicle.

22. The method of claim 21, wherein vibrating the diaphragm includes vibrating a portion of a cabin wall of a vehicle that includes a panel having a core, an inner sheet coupled to an inner surface of the core and an outer sheet coupled to an outer surface of the core, the panel having a weakened area defined by at least one open slot formed through the outer sheet, and wherein the tube is centered on the weakened area, the panel being integral with the cabin wall.

23. A dual coil loudspeaker system comprising:

a voice coil having a first coil configured to receive a first electrical signal from a first source, and a second coil configured to receive a second electrical signal from a second source different from the first source;

a field magnet configured to generate a magnetic field that interacts with magnetic fields created by the first coil and the second coil; and a diaphragm connected to the voice coil such that the diaphragm is displaced in response to energization of at least one of the first coil and the second coil;

the voice coil including a tube connected to the diaphragm, wherein the voice coil includes a releasable connection that releasably connects connect the tube to the diaphragm.

24. The dual coil loudspeaker system of claim 23, wherein the releasable connection includes a lock base attached to the diaphragm; and a lock pad attached to the tube and configured to be releasably attached to the lock base.

* * * * *